United States Patent [19]

Fascenda et al.

[11] 4,449,114

[45] May 15, 1984

[54] SYSTEM FOR IDENTIFYING AND DISPLAYING DATA TRANSMITTED BY WAY OF UNIQUE IDENTIFYING FREQUENCIES FROM MULTIPLE VEHICLES

[75] Inventors: Anthony C. Fascenda, Pacifica; Daniel L. Gregg, San Francisco, both of Calif.; Rollin W. Ache, Phoenixville, Pa.

[73] Assignee: Dataspeed, Inc., Burlingame, Calif.

[21] Appl. No.: 362,481

[22] Filed: Mar. 26, 1982

Related U.S. Application Data

[63] Continuation-in-part of Ser. No. 134,664, Mar. 27, 1980, abandoned.

[51] Int. Cl.[3] ..... G08B 1/12

[52] U.S. Cl. ..... 340/988; 340/323 R; 340/992; 364/410; 364/424; 364/460; 455/99; 273/86 R; 180/168

[58] Field of Search ..... 340/23, 32, 43, 311.1, 340/38 R, 38 L, 38 P, 38 S, 323 R, 825.36, 825.55; 364/410, 411, 424, 426, 436, 438, 460, 550, 551, 565, 566, 569, 715; 455/99-103, 132, 133; 180/168; 343/112 R, 112 C, 112 D, 112 S; 116/35 R; 235/92 TA, 92 GA; 273/86 R

[56] References Cited

U.S. PATENT DOCUMENTS

| | | | |
|---|---|---|---|
| 3,546,696 | 12/1970 | Waters et al. | 340/23 |
| 3,714,649 | 1/1973 | Brouwer et al. | 340/23 |
| 3,795,907 | 3/1974 | Edwards | 340/23 |
| 3,876,980 | 4/1975 | Haemmig et al. | 340/23 |
| 4,048,619 | 9/1977 | Forman et al. | 340/311.1 |

*Primary Examiner*—Donnie L. Crosland
*Attorney, Agent, or Firm*—Flehr, Hohbach, Test, Albritton & Herbert

[57] ABSTRACT

A system for detecting the location and identification of a number of vehicles at multiple points on a given track against a time gauge which includes an on-board transmitter on each vehicle of a unique identifying frequency, spaced receiving circuit elements along the track at multiple points connected to individual transmitters to receive and modify the identifying signal and transmit the signal to a programmed computer for translating the multiple signals of the different unique identifying frequencies into signals ascertainable on a portable hand apparatus selectively to indicate the speed of any selected vehicles as in a race, and to keep track of position standings and lap times.

5 Claims, 14 Drawing Figures

SYSTEM FOR IDENTIFYING AND DISPLAYING DATA TRANSMITTED BY WAY OF UNIQUE IDENTIFYING FREQUENCIES FROM MULTIPLE VEHICLES

CROSS REFERENCE TO RELATED APPLICATION

This is a continuation-in-part of application Ser. No. 134,664 which was filed Mar. 27, 1980 now abandoned.

BACKGROUND OF THE INVENTION

Heretofore, there were known individual measuring systems such as the vehicle separation measuring system of U.S. Pat. No. 3,796,864, which system measured only distance between vehicles but no time-difference or any other comparative data; also several systems of communication to individual vehicles for weather warning as in U.S. Pat. No. 3,283,397; or emergency communication system of U.S. Pat. No. 3,986,119; or vehicle speed monitoring system which signals in the vehicle that the allowable speed limit is exceeded in U.S. Pat. No. 3,686,043; or freight security system for electronic surveillance of freight from a central control as in U.S. Pat. No. 3,772,668.

None of the previous systems above mentioned is capable of instantaneous selective indication, on a hand-held portable apparatus, of the speed of the selected vehicle, and the distance between the moving vehicles, as in a race, and to keep track of position standings and lap times, which can be accomplished by manipulating selected buttons on the hand-held apparatus. Furthermore, none of the prior art is capable simultaneously to also display the selected characteristics of moving vehicles on a billboard.

The primary object of the invention is to provide a system whereby vehicles along multiple monitoring points broadcast their own attitude and position, and to provide simple portable units receiving and translating selectively the information on any of several moving vehicles.

Another object of the invention is to provide a simple system for detecting the unique signals of a number of vehicles at multiple monitoring points on a given track and to translate the detected signals for information on the attitude and comparative location and other selected characteristics of the respective vehicles.

DETAILED DESCRIPTION

The term "vehicle" when used herein is intended to include any object moving on a path or track.

Figure 1:
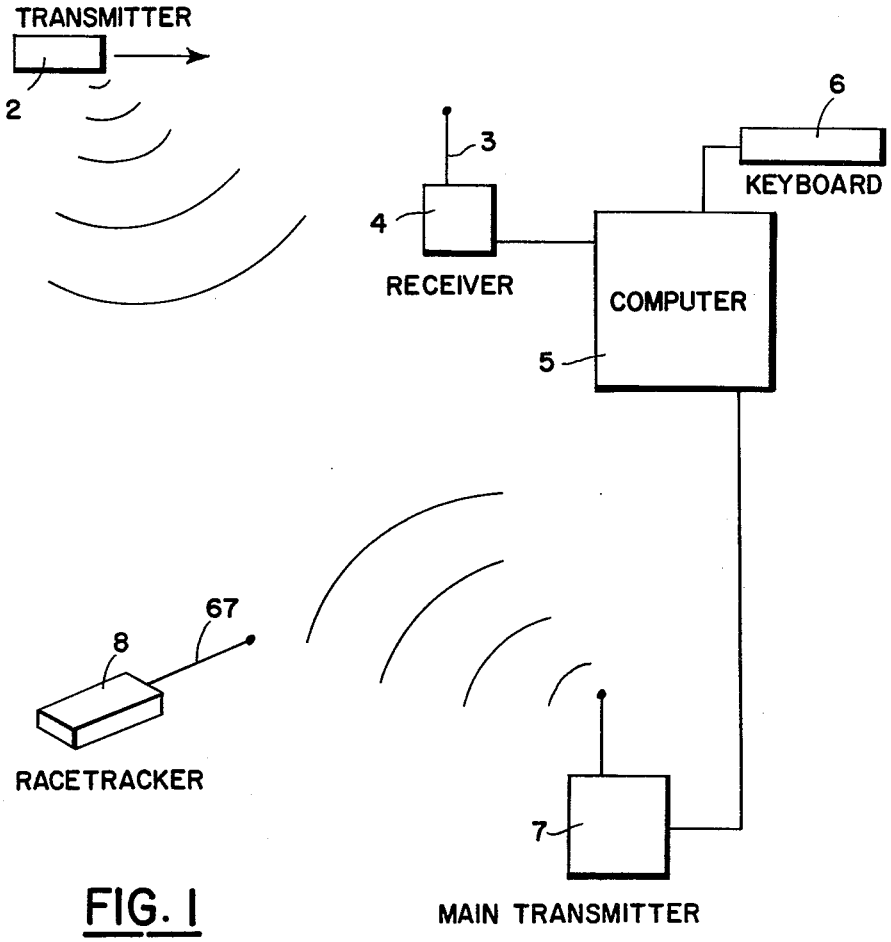
FIG. 1 is a diagrammatic view of the overall system.
Figure 2:
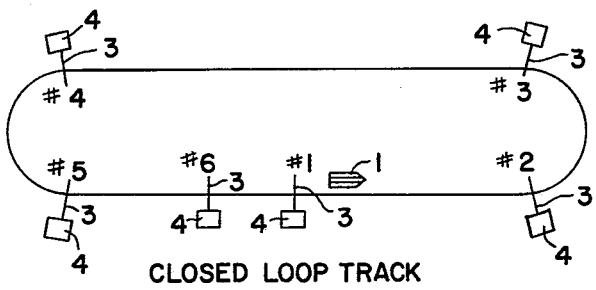
FIG. 2 is a diagrammatic view of the arrangement of the receiving antennas illustrating the spacing of the receiving antennas and circuits along the path of a closed loop track.
Figure 8:
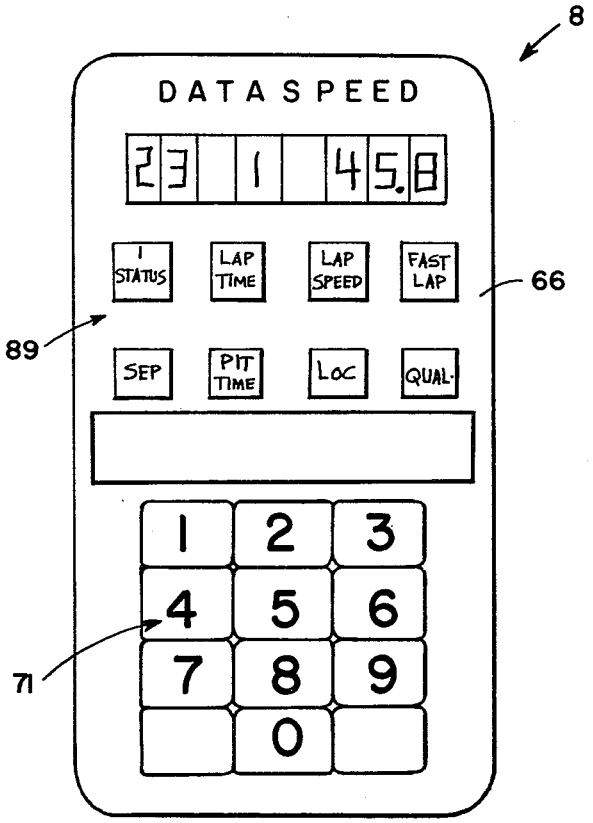
FIG. 8 is a view of a portable hand-receiver.
Figure 9:
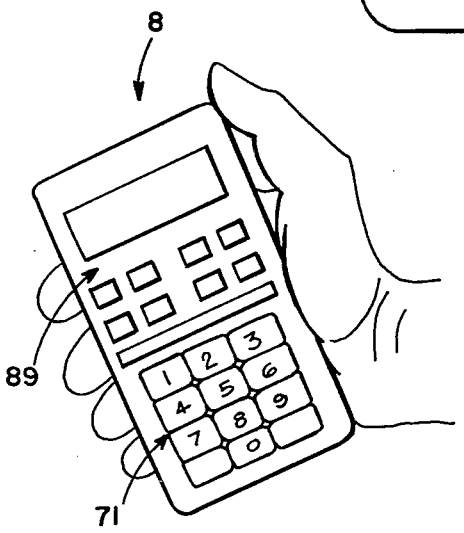
FIG. 9 shows the hand-receiver in hand.

As shown in FIG. 1 and FIG. 2 on each vehicle 1, there is an individual vehicle transmitter 2 which broadcasts a signal on a unique identifying frequency. Along the track are spaced receiving antennas 3, each of which is connected to a receiver 4, which may be adjacent to the track or remote from it. The receivers 4 feed the signals into a programmed computer 5 from which the signals are transmitted to a keyboard 6 for selecting and displaying the desired information as to any selected vehicle 1. The signal is transmitted also to a main broadcasting transmitter 7 which broadcasts the information to a hand-receiver 8, also called a racetracker, for instance of the type shown in FIG. 8. The computer 5 is programmed to compute the speed of each vehicle, the distance between vehicles on the track, and to keep track of position standings and lap times of the respective vehicles.

THE VEHICLE TRANSMITTER

Figure 3:
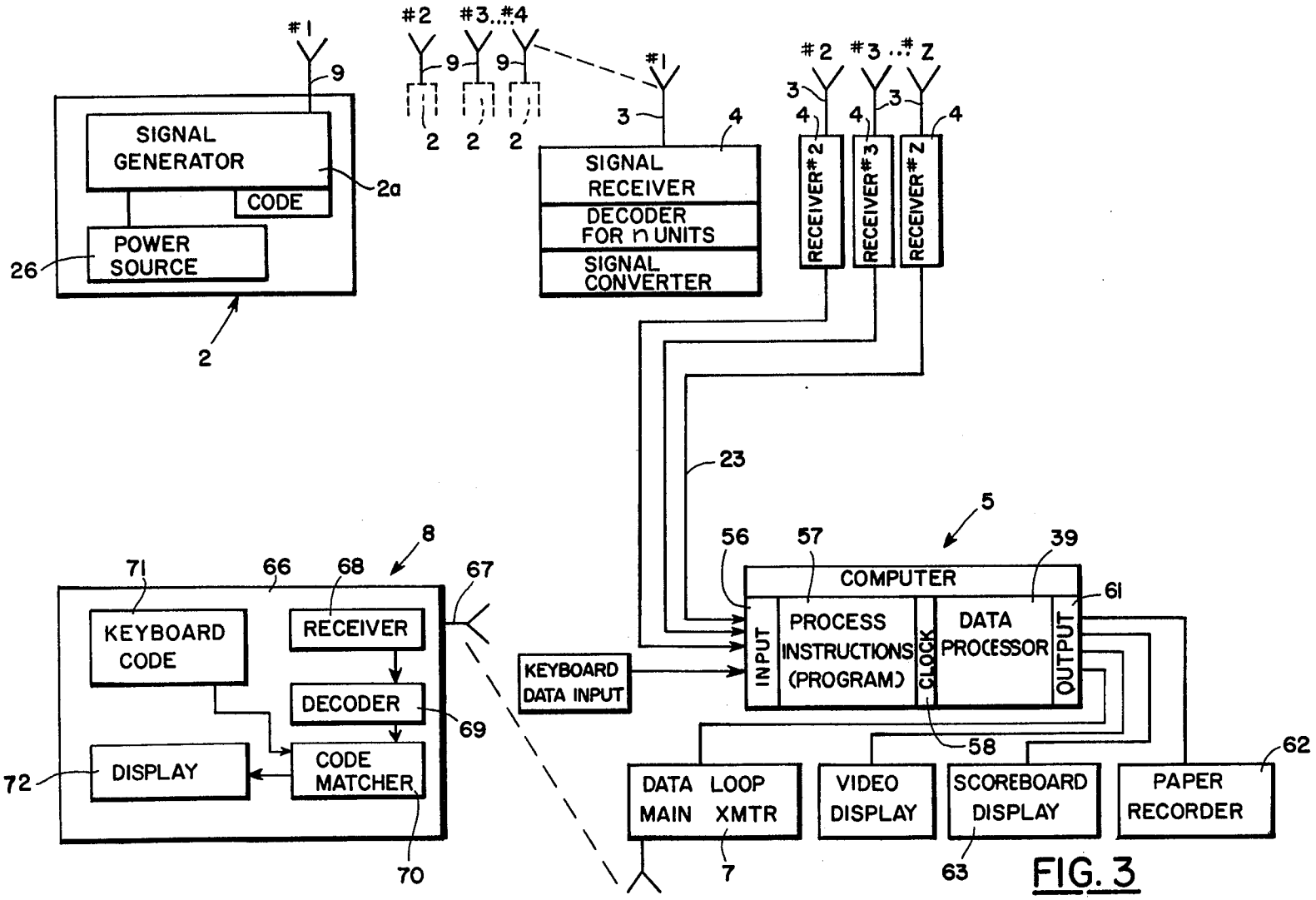
FIG. 3 is a more detailed diagram showing the arrangement for the broadcasting of the unique frequency signals to the receiving and broadcasting circuits.

Each vehicle transmitter 2, as shown in FIG. 3, inclues a transmitter antenna 9, a signal generator **2*a* and a local power source 2*b*. The signal generator generates a unique identifying frequency for the particular vehicle 1**.

Figure 4:
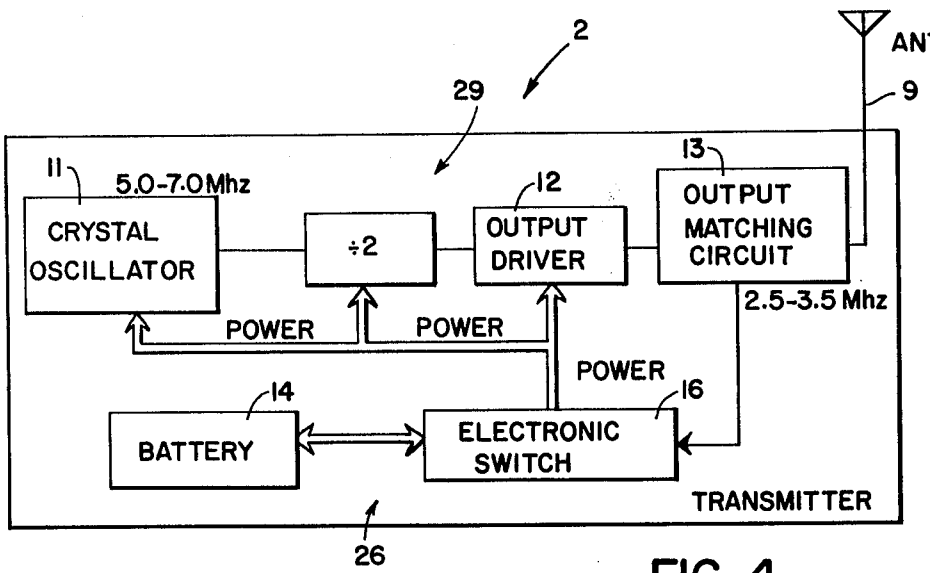
FIG. 4 is a block diagram of the vehicle transmitter.

The transmitter circuit is shown on the block diagram in FIG. 4, and it includes a crystal oscillator 11, output driver 12, output matching circuit 13, a built-in rechargeable battery 14, and an electronic switch 16.

In the herein illustrative embodiment, the crystal oscillator 11 operates in the range of 5.00 to 7.00 Mhz with frequencies of adjacent transmitters spaced 20 khz apart. This range of frequencies is divided in half exactly to the final output frequency to permit the use of a physically smaller crystal size, with attendant reduction of crystal mass. Crystal frequency error is likewise cut in half after the division process. Thus, by starting out twice as high as in the final output frequency, less massive crystal is used which is also more resistant to the vibration and shock on a moving vehicle.

The output frequency of the crystal oscillator 11 is divided in half to the final output frequency in the present illustration to 2.5 to 3.5 Mhz. Channel spacing, namely, the spacing between the identifying frequencies in the system, is also divided in half to the final channel spacing of 10 khz. The output frequency is then fed to the output driver 12, and then to the output matching circuit 13. In the herein embodiment, the divided state and the crystal oscillator are in an integrated circuit, and are both an oscillator and a power amplifier.

The transmitter antenna 9 is attached to the side of the vehicle 1 with a length of coaxial cable not shown, and is connected to the output matching circuit 13, which consists of tuned inductor and capacitor circuit.

Figure 11:
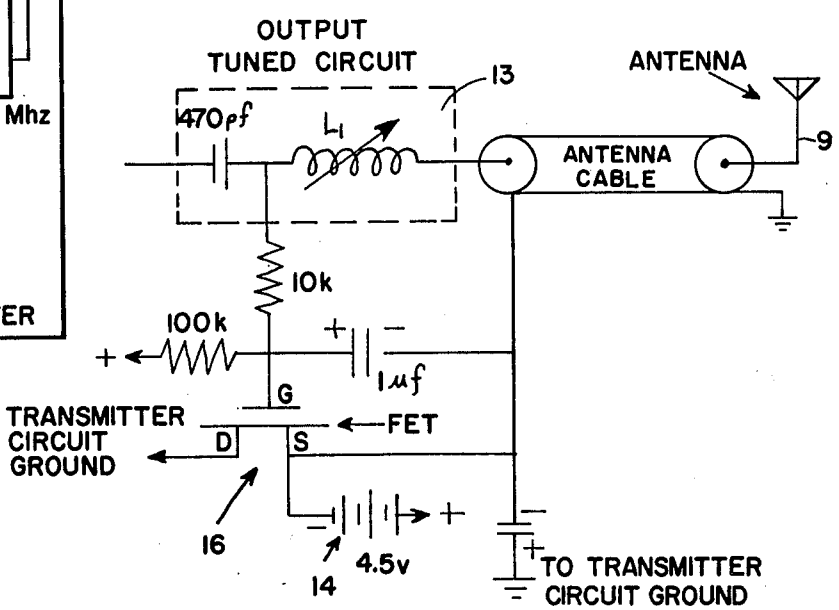
FIG. 11 is a wiring diagram of the electronic switch.

Power is supplied to each vehicle transmitter by the rechargeable battery 14 controlled by the electronic switch 16. The electronic switch is a field effect transistor (FET) which isolates the circuit ground from the battery 14 ground reference, as shown in FIG. 11.

The FET is biased on the "on" position by a resistor tied to the output circuit. When the output circuit is shorted to ground, the FET is biased "off". This removes the ground reference from the circuit ground and the transmitter stops transmitting and hence greatly reduces battery drain. The only drain from the circuit is the very small drain needed to bias the FET in the "off" position.

There are no moving parts or switches involved in the vehicle transmitter thereby reducing the possibility of mechanical failure.

THE SIGNAL RECEIVER

Figure 5:
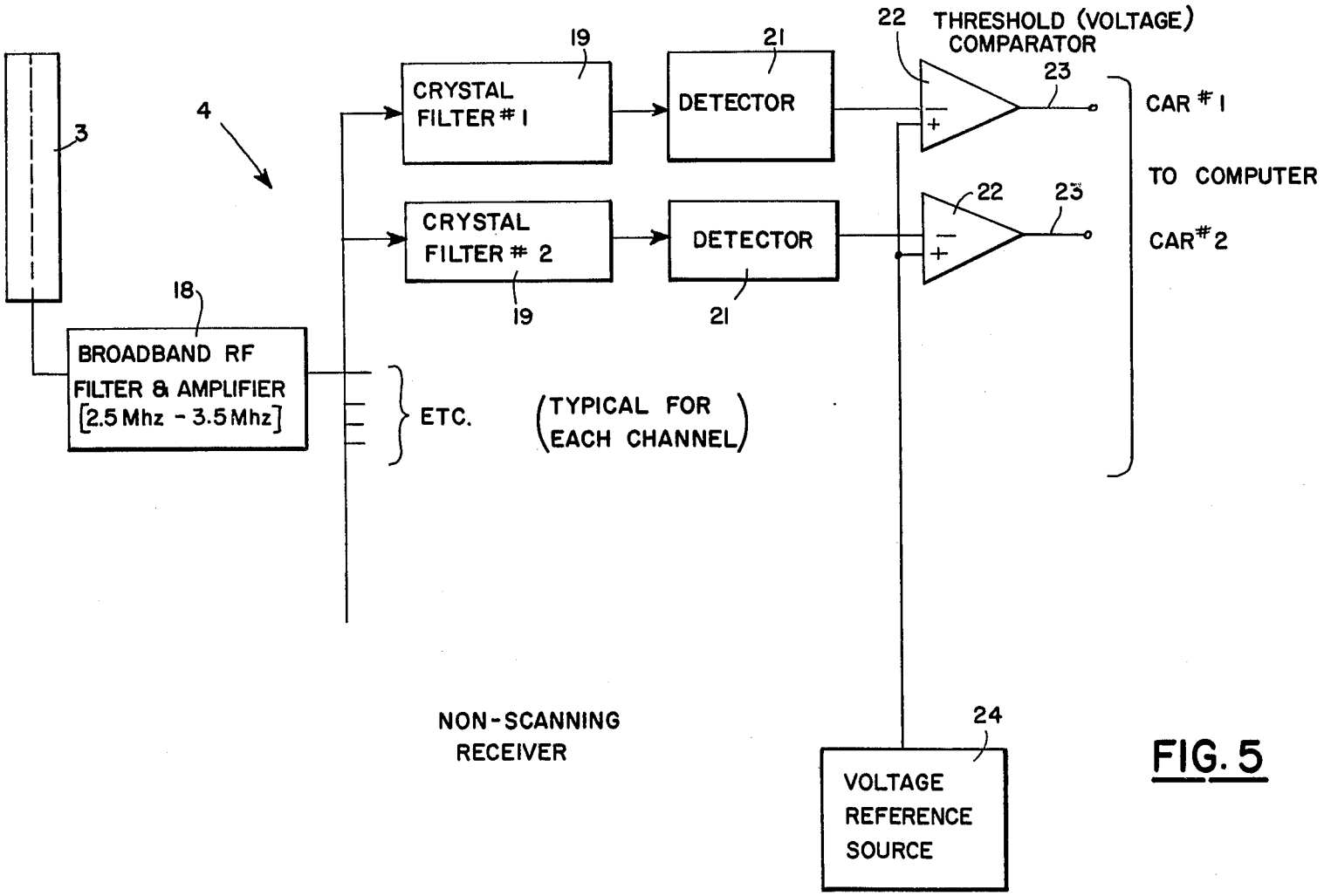
FIG. 5 is a diagram showing the non-scanning receiving circuit.

The integrated circuit of the non-scanning signal receiver 4 is shown in FIG. 5, and it includes the receiving strip antenna 3, a broadband amplifier and filter 18 which brings the signals up to a suitable strength, and for each transmitter frequency channel a crystal filter 19 connected to a detector circuit 21, which latter is connected to a threshold voltage comparator 22. The output of these individual receivers 4 is fed into the programmed computer 5, through suitable connection 23. The computer 5 is connected to the main broadcaster transmitter 7, which continuously broadcasts sequentially the programmed unique signals.

Each crystal filter 19 is of the exact frequency of the final output of the output matching circuit 13 of the respective vehicle transmitter 2 from its matching transmitter frequency.

Each detector circuit 21 is in the form of a half-wave voltage doubler. The output of each detector circuit 21 is compared in its threshold comparator 22 against a voltage reference source 24. If the signal is above the threshold voltage, the output of the comparator will change state from a logic "0" to the logic state "1", so that the computer 5 may deal with the binary data.

THE SCANNING SIGNAL RECEIVER

Figure 6:
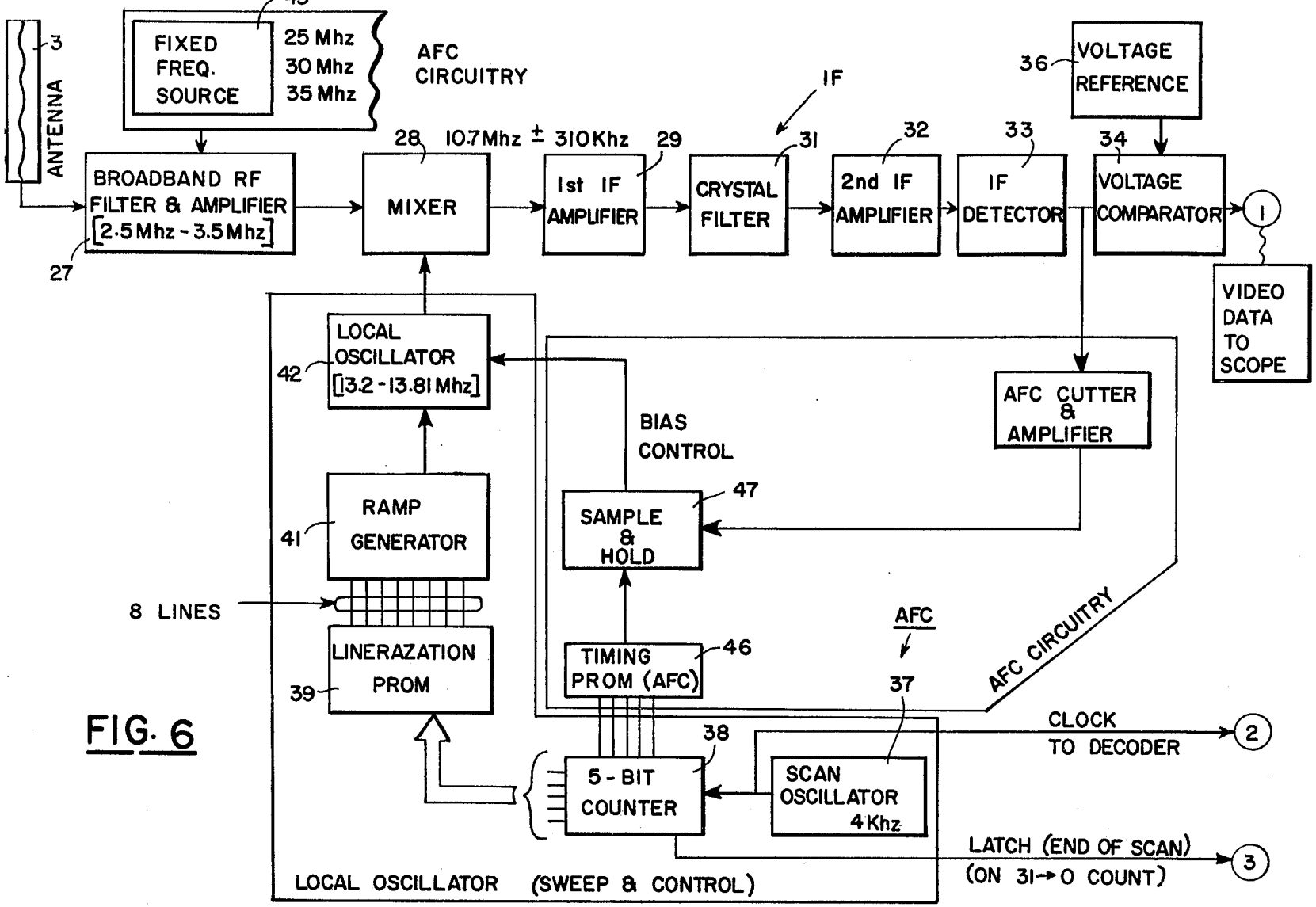
FIG. 6 is a block diagram of a scanning receiver circuit.

In this form of the receiver, the integrated circuits, of which is shown in FIG. 6, the receiver strip antenna 3 is connected to a broadband RF filter and amplifier 27 which connects into a basically single conversion superheterodyne circuit, the normal crystal oscillator of which is replaced by a digitally controlled sweep oscillator which sweeps sequentially through the frequency range searching for the presence of potential transmitter frequencies.

The broadband filter and amplifier 27 feeds into a mixer 28, which then feeds into an Intermediate-Frequency amplifier section (IF). This section includes a first IF amplifier 29, a crystal filter 31, a second IF amplifier 32, and an IF detector 33, feeding into a voltage comparator 34, which latter is supplied by a voltage reference 36. The output of the voltage comparator drives a decoder circuitry.

The second section of this integrated circuit is a Local Oscillator and Sweep Control section. A scan oscillator 37 in this embodiment runs at 4000 hz and drives a 5-bit binary counter 38 which counts 0–31. The 5-bit output of the counter 38 drives a preprogrammed "linearization" programmable read-only memory 39, herein referred to as "prom". This prom 39 converts the linear 5-bit count into an 8-bit non-linear count matched to the tuning characteristics of the mixer component. The linearization prom 39 along with a ramp generator 41 makes up a digital-to-analog converter feeding into a local oscillator 42 which sweeps, in the illustrative embodiment herein, from 13.2 Mhz (10.7+2.5 Mhz) to 13.8 Mhz (10.7+2.81 Mhz) for a 32 vehicle system. This feeds into the mixer 28 and IF section so that the amplifier, crystal filter and detector of the IF section will indicate the presence of a particular transmitter signal precisely at the instant when the corresponding channel count is held in the 5-bit counter 38.

The third section is an Automatic Frequency Control section hereinafter referred to as AFC. This section consists of a fixed frequency source 43 consisting of three frequency references built into the receiver; one at the midpoint of the scan range, and one at each end of the scan range. The output of the 5-bit counter 38 besides driving the linearization prom 39, also drives a timing prom 46. Whenever the count of the 5-bit counter, for instance, is 0, 16 or 31, a sample and hold circuitry 47 is activated and samples the output of the final IF detector 33 during its window period, such as a 250 msec window period, allotted to each frequency. If the receiver is locked on the output frequency of the sample and hold circuitry 47, there will be no change in the bias signal to the local oscillator 37. If the receiver is not exactly on frequency, the sample and hold circuitry 47 will cause a slight bias signal to be applied to the local oscillator 37 to move in a direction opposite from its drift. The receiver oscillator frequency, therefore, is checked three times during each 8 msec scan period, thereby allowing very tight tolerances and close channel spacing to be maintained.

Figure 7:
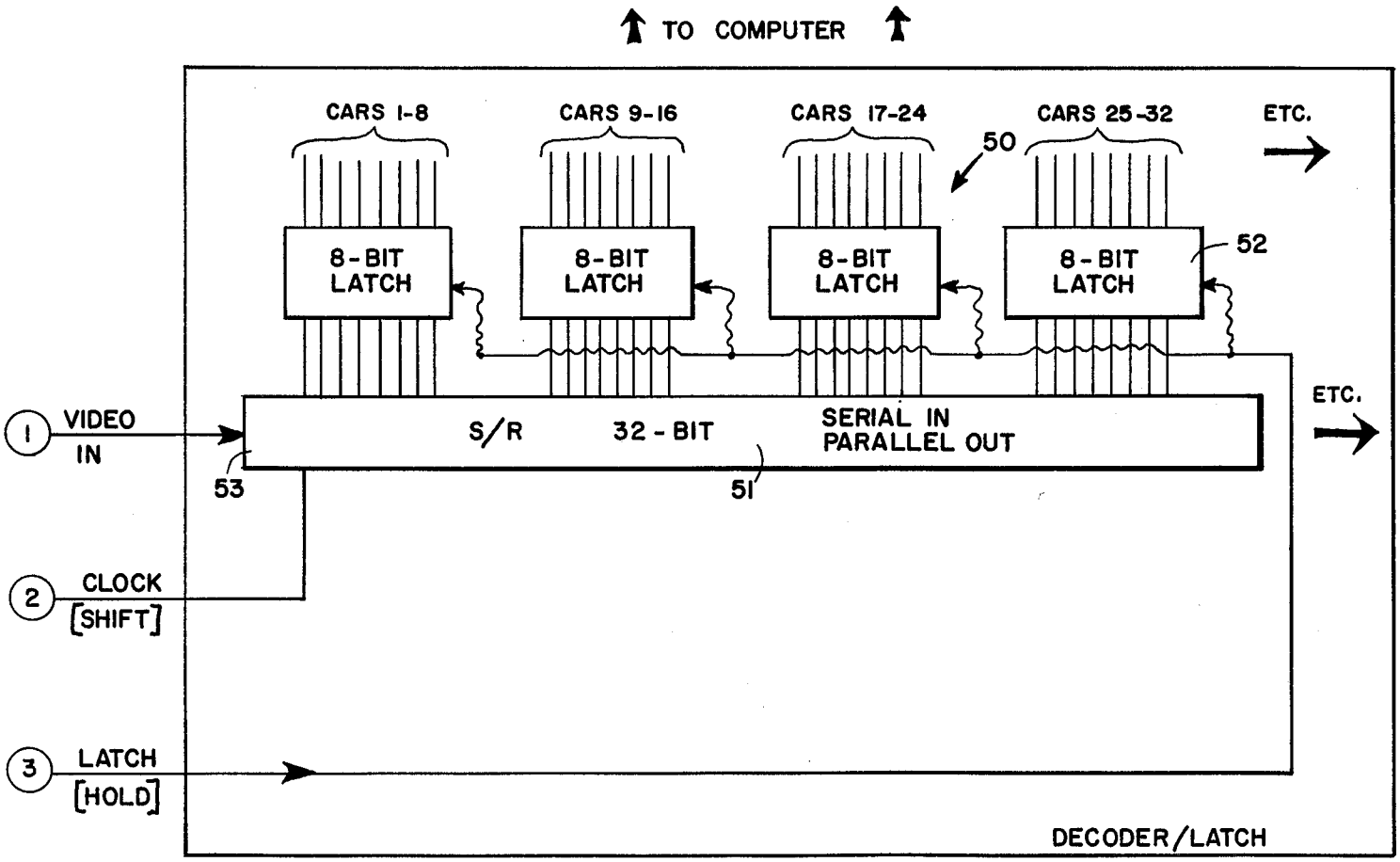
FIG. 7 is a block diagram of the signal counters for groups of signals.

A decoder circuit shown in FIG. 7 is a serial-to-parallel shift register 51 with a latching mechanism 52. The parallel output of the shift register is latched at the end of each 5-bit count and held to the end of the next 5-bit count freezing the results of the scan for another 8 msec. The output of the voltage comparator 22 is inputted to the serial input 53 of the shift register 51. Each time the 5-bit counter is incremented, the shift register 51 is clocked one bit. Synchronization with the count is maintained via the end-to-scan signal. The shift register feeds the signal into the computer 5.

THE COMPUTER

The coaxial cable 23 from either receiver is connected to the input 56 of the computer 23 and to the process instruction circuit 57 indicated in FIG. 3. The computer also contains a clock circuit 58 and the Data Processor circuit 59. The output 61 may be connected to a paper recorder 62, or scoreboard display 63, or video display 64.

The main broadcasting transmitter 7, indicated as a data loop transmitter on FIG. 3, is also connected to the computer outlet circuit 71.

THE HAND DISPLAY RECEIVER

As shown in FIG. 3, the hand receiver is a Data loop converter. It contains in a hand casing 66, an antenna 67, a receiver 68, a decoder 69, a code matcher 70, keyboard code circuit 71, and a display circuit 72.

Figure 10:
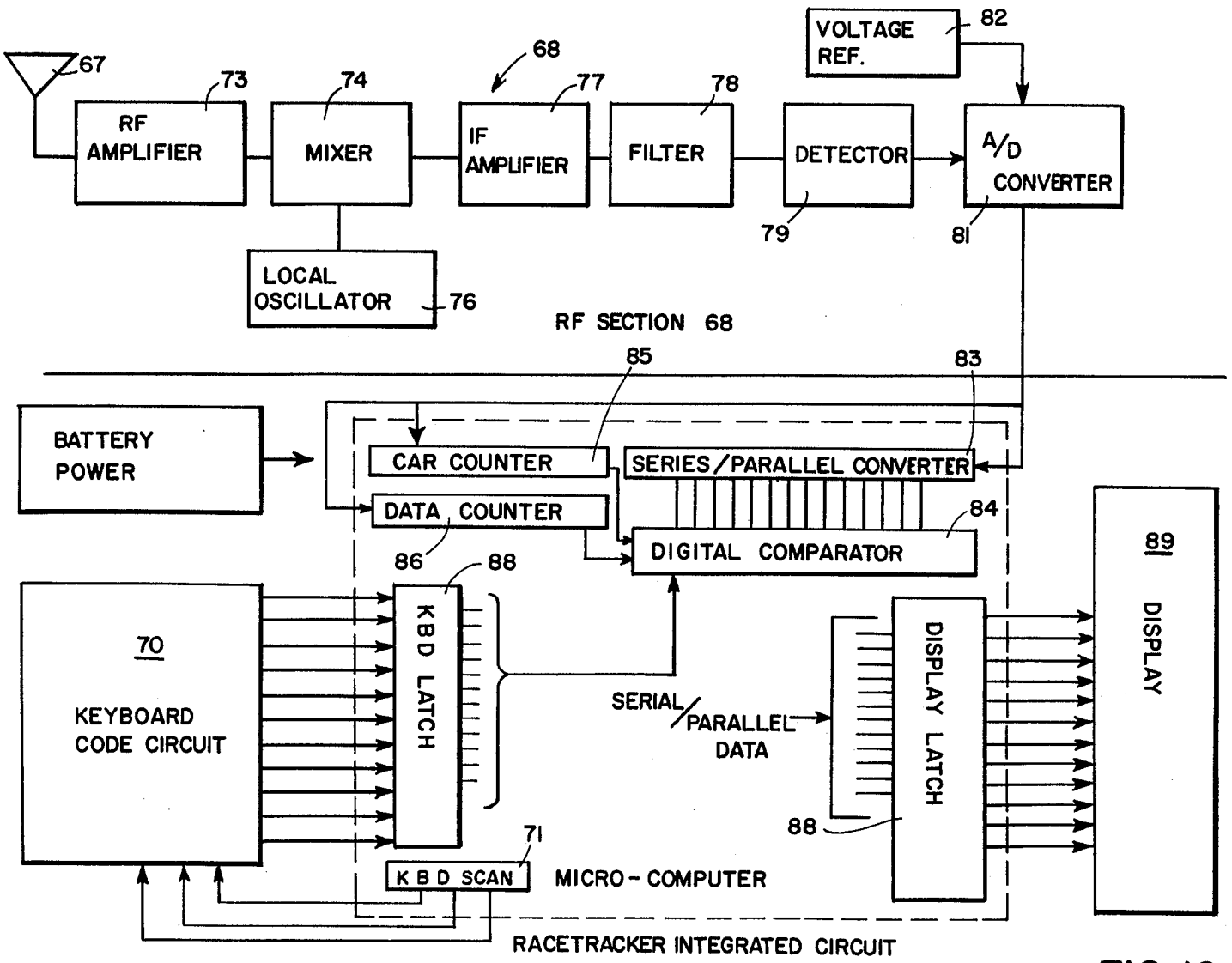
FIG. 10 is a block diagram of the portable hand-receiver.

The integrated circuit of the hand receiver is illustrated in more detail in FIG. 10.

The receiving section 68 includes an RF amplifier 73, a mixer 74, a local sweep oscillator 76, an IF amplifier 77, or filter 78, a detector 79, and an A/D converter 81 interconnected with a voltage reference 82.

The A/D converter feeds into a series-parallel converter 83, which latter feeds the signals into a programmed digital computer 84. A car counter circuit 85 and data counter circuit 86 feeding from the A/D converter 81, each into the digital computer 84.

The computer 84 transmits a continuous closed loop data stream containing a series of digital pulses representing both data and synchronization pulses. The information desired by the user is fed and stored in a keyboard latch 87 within this microcomputer circuit which is essentially a one chip device.

The latch then holds the data on the display until either a new keyboard entry is made or the computer (84) updates the information in the closed data loop of the selector.

OPERATION

The transmitter unit is installed on each vehicle 1. The receiver antennas 3 are positioned at spaced intervals along the track.

Figure 12:
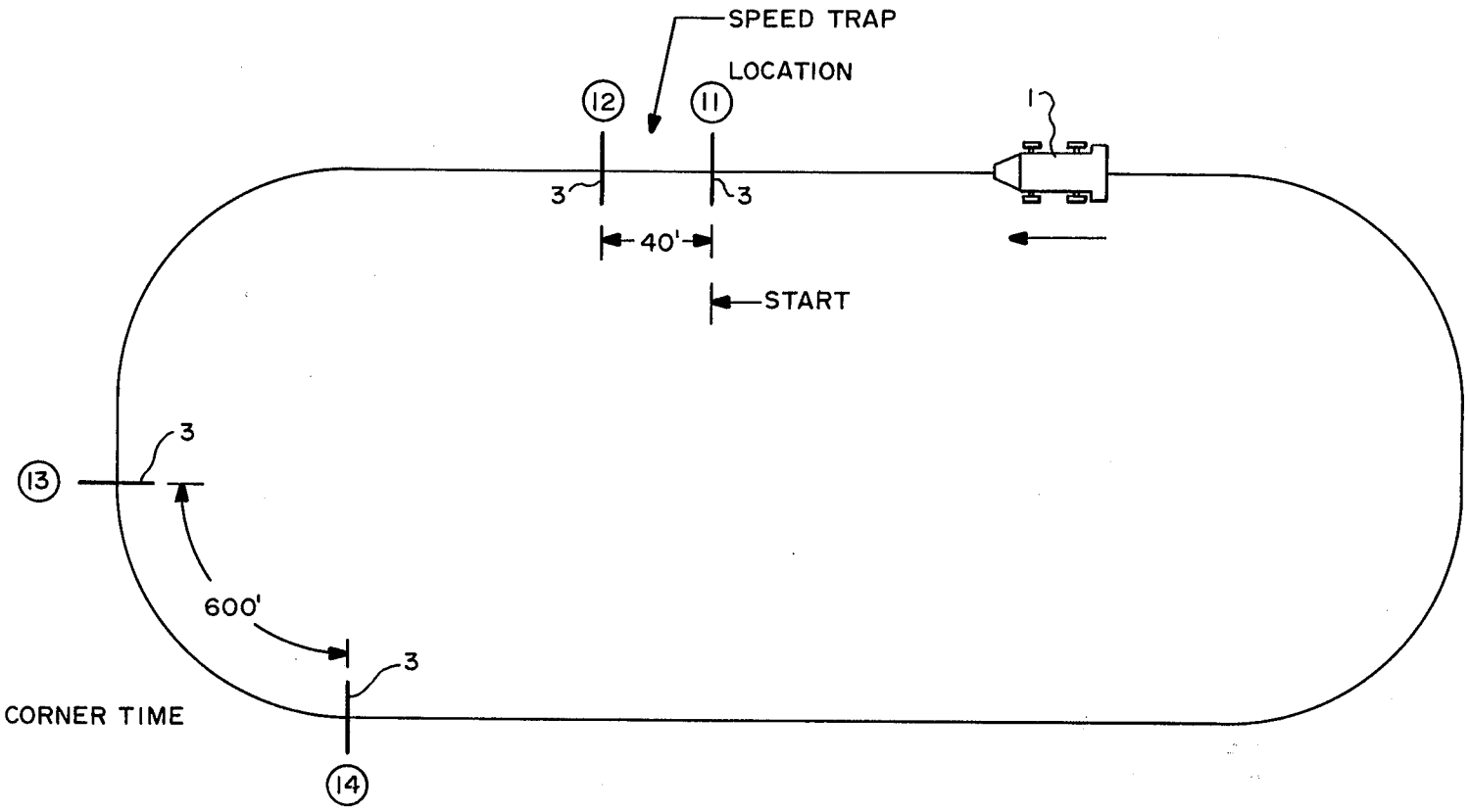
FIG. 12 is a diagrammatic view of an alternative arrangement of receiving antennas on a racetrack.

As the vehicles 1 travel past the received antennas 3, the respective sequentially positioned receiver antennas 3 receive the signals of the respective unique identifying frequency for the respective vehicle transmitter 2. All the signals received by the receiver antennas 3 are transmitted to the non-scanning receiver circuit shown in FIG. 5, or to the scanning receiver circuit shown in FIG. 6, as the case may be, and there are modified as heretofore described and fed into the programmed computer 39, and then to the main transmitter 7 for broadcasting, to the hand receiver 8. If it is desired to display on the billboard 6, the latter has substantially the same circuits as the hand receiver, except that instead of a keyboard selector, the continuous stream of pulses causes sequential display of the information regarding the vehicles.

Where it is desired to minimize the amount of cabling at the racetrack and to provide additional race information, an antenna layout such as in FIG. 12 can be utilized. Here a pair of antennas at locations 11 and 12 which are, for example, spaced 40 feet apart and with location 11 being at the start, provide a speed trap so that the speed at that start location can be sensed every time a car loops the racetrack. In addition, of course, the elapsed time for the entire track circuit, as determined by the antenna at location 11, also provides the lap time and average speed for the entire lap.

Antennas 3 at locations 13 and 14, which are spaced at opposite ends of a corner of the track and in this example 600 feet apart, provide the corner time and thus the speed for vehicles in this part of the track.

Thus, the foregoing is an indication of the driver's capability and his car's performance, both on the straightaway, that is, the locations 11,12 and at a corner 13,14.

Figure 13:
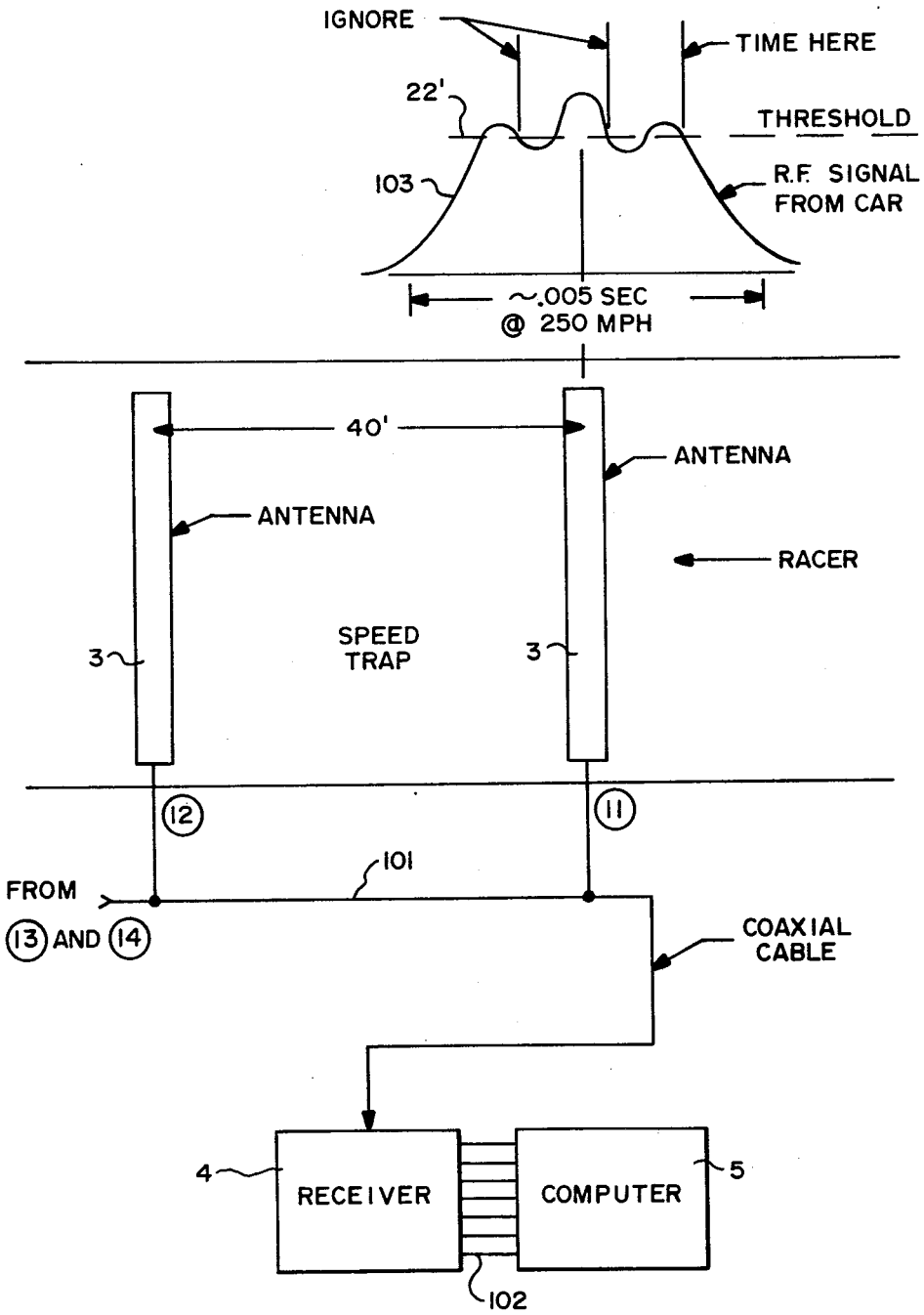
FIG. 13 is a diagrammatic view of an enlarged portion of a pair of antennas of FIG. 12, and also illustrates the connection of the antennas to the central timing system computer.

FIG. 13 illustrates the antennas 3 at the locations 11 and 12 in greater detail. Each antenna 3 is actually a metal strip which is embedded across the track width. The antennas are connected to a common coaxial cable 101 which provides a common transmission path for the various unique signal frequencies from each race car to a receiver 4.

Receiver 4 may either be of the non-scanning type as illustrated in FIG. 5 or the scanning type illustrated in FIG. 6. However, is should be emphasized that only one receiver 4 need be used with the common coaxial cable which as shown in FIG. 13 is connected to all antennas. Receiver 4 has its outputs directly inputed to computer 5 by means of the several lines 102. These lines, of course, are comparable, for example, in FIG. 5 to the individual lines 23. But, in accordance with the circuit of FIG. 13, rather than routing a bundle of lines 23 from each receiver 4 which is located at each antenna 3 on the racetrack, only a single coaxial cable 101 need be used.

However, as is apparent, the comingling of these signals from various antennas presents the problem of determining which car has passed which antenna at a particular time. Its solution will be discussed in conjunction with the flow chart of FIG. 14.

But first continuing with FIG. 13, when a race car passes, for example, the first antenna at location 11, as illustrated in FIG. 13, the antenna receives a radio frequency signal from the race car such as 103. And the signal is symmetrical, beginning to rise from a zero level as the car approaches the antenna, oscillating somewhat and then reaching maximum as the car passes over the antenna and then oscillating again and falling as the car moves away. As illustrated in FIG. 5, the receiver includes a threshold comparator 22 and this level is indicated by the line 22'. Moreoever, it is obvious that because of the oscillations or "bouncing" of the signal that in addition to the initial point designated 104 and labeled "time here", where the signal first exceeds the threshold, there are two additional false indications which have been labeled "ignore". In accordance with the present invention, computer 5, in conjunction with a delay technique, after a signal is first received and exceeds the threshold 22', will ignore for a period of time at least exceeding the, for example, 055 seconds which would occur with a 250 mph car, any subsequent signals during this "bounce" time.

Figure 14:
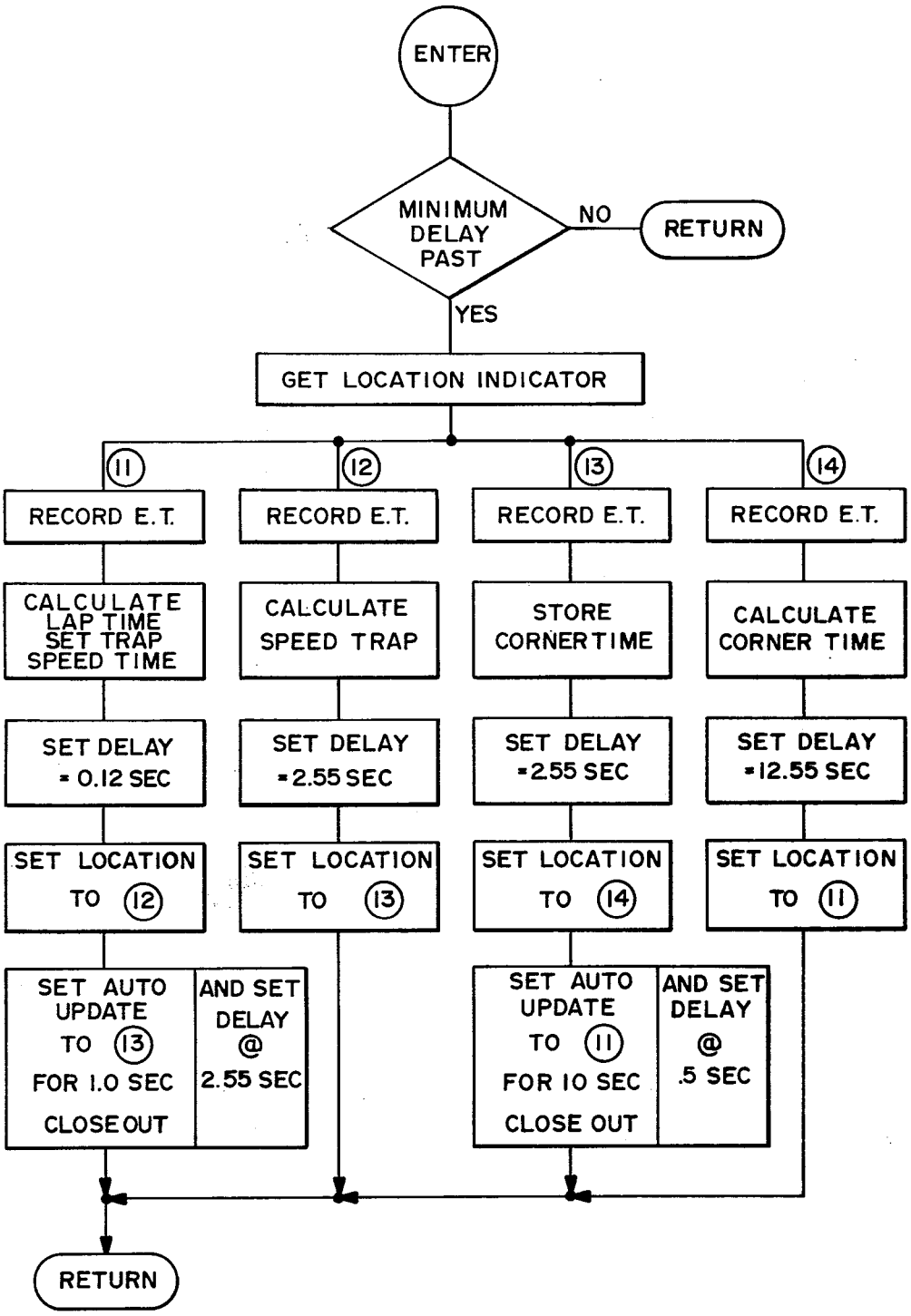
FIG. 14 is a flow chart showing the timing used in the computer of FIG. 13.

Now referring to FIG. 14, as was discussed previously, a number of antennas are connected on the common coaxial cable 101 to the receiver and in turn the computer. The computer has no way of knowing from which antenna the signal was generated. Thus, the computer or the timing system must have some means of determining over which antenna the car has passed. The timing of FIG. 14 provides this.

Referring specifically now to the flow chart, there is an enter point and then a decision as to whether a minimum delay has passed. If it has not, then return is made to enter and no data will be recorded. When the previously set minimum delay has been passed, then a block "get location indicator" refers to a previously set location; referring to FIG. 12, the possible locations are 11, 12, 13 or 14. FIG. 14 has four branches corresponding to these locations. Thus, the computer will process along one of these branches depending on the location indicator. With each branch, the first step is to record the elapsed time(E.T.). It might be mentioned that, of course, the program is initiated any time that a signal is received by the receiver 4 from any antenna.

Next, referring specifically to the branch 11, since, as illustrated in FIG. 12, location 11 is also the start, the next step is to calculate the lap time. This is done by comparing to the previous elapsed time for that particular race car. In addition, since location 11 is the beginning of the speed trap, the initial conditions for calculating the trap speed time are set up.

Next, a minimum delay of 0.120 seconds is set. This is under the assumption that a car cannot be going as fast as 250 mph. This, if a second signal, for example, from antenna 12 were to be received within that time, it could not be a valid signal; and thus, it is ignored. Thus, this provides for debouncing in accordance with the discussion of FIG. 13 and the wave form 103 or against any other false signal condition as will be described below.

After the delay is set, the location is set at 12 since it is assumed that the car will pass through the exit antenna of the speed trap. If this occurs within one second, the signal is received at location 12, the program is "entered", and the branch 12 records the elapsed time, calculates the speed trap, sets a delay at 2.55 seconds, and then sets the location indicator to the next sequential location on the track which is the beginning of the corner 13.

However, in accordance with the "auto update" feature of branch 11, if the car, for example, would leave the track after passing location 11, then the trap would be automatically closed in one second, and the location indicator set to 13. And, also at this time, a delay is set for 2.55 seconds since the computer does not expect to see any more signals for at least this period of time; that is, the time a car leaves 12 and is moving toward location 13. In addition, this 2.55 seconds delay in the last step of branch 11 prevents the recording of a signal if a car is moving slower than, for example, 27.1 mph. Supposing a car traveling from location 11 to 12 suddenly developed mechanical problems. Even though the one second close-out time would have expired and thus no true signal for location 12 would be recorded, it is still important that a false signal not be recorded for location 13 to which the auto update feature has now set the location indicator. Thus, this additional delay set provides against that.

Referring to branch 12, the minimum set delay of 2.55 seconds in the third step of that branch provides in a normal course that after leaving the gate 12 it is not expected that any signal should be received for that period of time since the location of gate 13 is appreciably further.

Thus, summarizing the speed trap of locations 11 and 12, the timing provides a valid window in time which ranges from 0.120 seconds to one second within which, after receiving the signal at location 11, a second signal from antenna 12 may be validly received.

Branches 13 and 14 correspond to the corner speed trap or corner time and are similar to the initial trap 11,12, except that in branch 13 the minimum delay is set at 2.55 seconds. This is the minimum time it would require a car traveling, for example, 176 mph to round a corner of 600 feet in length. This time is, of course, lower than the assumed maximum 250 mph since that was the straightaway time. Thus, continuing on the branch 13 after the minimum delay of 2.55 seconds is set the location indicator is set to the end of the corner; that is, at 14. The maximum window or the close-out auto update time is set for 10 seconds which would correspond to a slowest speed of 40.6 mph. That is, after passing the location 13, the car must pass location 14 within 10 seconds. If it does not, it is going slower than 40.6 mph, and another delay is set at 5 seconds to prevent subsequent reception of a signal which the computer would interpret otherwise as coming from location 11 since the auto update at branch 13 has reset the location indicator to 11. Thus, with regard to the corner time, the valid window is a minimum of 2.55 seconds and a maximum of 10 seconds.

Lastly, in branch 14, assuming the car passes location 14 within the valid window time, the elapsed time is recorded, the corner time and speed is calculated, and a minimum delay of 12.55 seconds is set, and the location is then set to 11. This 12.55 second delay, referring to FIG. 12, ensures that during the great distance between location 14 and location 11 that no erroneous or false signals will be received.

With the use of the auto update instructions of branches 11 and 13 where the location indicator is jumped an additional location, for example, in the case of branch 11 to 13 instead of 12, the location of the car will within two laps be placed in the proper sequence, even if the computer did not initially know where the car was located. This is, of course, accomplished by proper placement of the antenna pairs around the track and providing substantially different spacing between the individual antennas of one pair compared to the other. And by knowing the basic performance aspects such as minimum and maximum speeds of the vehicles being raced, the timing system can easily track the location of all cars.

In one final example, assume that a car enters the track between locations 11 and 12. The first signal received will be assumed to be the location 11 even though the car is not there. But, since the car will not cross the antenna at location 13 for some time, the speed trap will automatically close in one second, and the location is updated by means of the auto update to location 13. This places the car in the proper location.

Next, assume a car enters the track just before location 13. As antenna 13 is passed, the computer will think that the car is at location 11. However, the close-out time of one second will expire before the car can possibly complete the corner, crossing over the antenna at 14. As the car passes location 14, the receiver and computer will think the car is at location 13, and the corner time will be set. But the car will not reach location 11 before the corner time is closed-out (that is, 10 seconds), and the auto update of branch 13 will be set to 11. Therefore, the car will now be in synchronization.

Thus, by a proper spacing of the antennas, providing valid windows and minimum delays, the location of the car can be easily tracked by the computer. This is true even though all of the unique signal frequencies of the cars from all antennas are comingled on a single coaxial line.

We claim:

1. A system for detecting and indicating relative location and speed of a number of vehicles on a closed racetrack where each vehicle generates a unique radio frequency identification signal, said vehicle making a plurality of laps around said racetrack in a given race and also temporarily leaving and then re-entering said racetrack, said system comprising:

a plurality of antennas on said track at spaced locations for sensing said signals as said vehicles pass;

a first pair of antennas spaced relatively close together compared to the overall racetrack length to provide a speed trap;

a second pair of antennas spaced significantly greater apart than said first pair and located relatively far from said first pair;

common cable means for interconnecting all of said antennas for receiving said signals of various frequencies on a common transmission path;

timing means connected to said cable means for recording elapsed times of vehicles between antenna locations having minimum valid times between said various antenna locations and having preset and different maximum times for the passage of a vehicle between said two antennas of said first pair and said antennas of said second pair, said maximum times being based on said antenna pair spacing and a minimum vehicle speed, said timing means including update means responsive to a vehicle not passing through one of said antenna pairs in said preset maximum time for said one antenna pair for updating the location of said vehicle to said other antenna pair, whereby the true location of said vehicle on said racetrack is established despite pitstops and/or mechanical difficulties.

2. A system as in claim 1 where said timing means includes signal receiving means responsive only to signals above a predetermined threshold level and delay means for causing said timing means to ignore subsequent signals above said threshold for a predetermined delay time.

3. A system as in claim 1 where said second pair of antennas are spaced from each other at opposite ends of a corner on said racetrack to provide the time of passage of a vehicle around such corner.

4. A system as in claim 1 including a hand-held portable receiver for selectively receiving the relative location and speed of said vehicles on said track.

5. A system as in claim 1 where said first pair of antennas is on a straightaway of said racetrack to provide a maximum speed.

* * * * *